United States Patent [19]

Bair, III

[11] 4,347,643

[45] Sep. 7, 1982

[54] POWER ASSIST DRIVE UPRIGHT VACUUM CLEANER AND POWER ASSIST DRIVE SYSTEM THEREFOR

[75] Inventor: Scott S. Bair, III, Atlanta, Ga.

[73] Assignee: The Singer Company, Stamford, Conn.

[21] Appl. No.: 228,021

[22] Filed: Jan. 23, 1981

[51] Int. Cl.[3] ..... A47L 9/00

[52] U.S. Cl. ..... 15/340; 180/19 H

[58] Field of Search ..... 15/340, 410; 180/19 H; 192/48.9, 48.91

[56] References Cited

U.S. PATENT DOCUMENTS

| | | | |
|---|---|---|---|
| 2,619,209 | 11/1952 | Horn | 15/340 X |
| 3,218,876 | 11/1965 | Berger | 15/340 X |
| 3,618,687 | 11/1971 | Ripple et al. | 15/340 X |
| 3,938,216 | 2/1976 | Schmitz et al. | 15/340 |
| 4,249,281 | 2/1981 | Meyer et al. | 15/410 X |

*Primary Examiner*—Chris K. Moore

*Attorney, Agent, or Firm*—Robert E. Smith; Edward L. Bell

[57] ABSTRACT

An upright suction carpet cleaner is provided with a solid rear axle having wheels mounted on either end thereof and a power assist transmission generally medially mounted therewith. The transmission comprises a housing carrying an input pinion gear driven from the suction fan motor shaft in constant mesh with a pair of contra-rotating face gears freely rotatable upon the axle shaft. A pair of clutch assemblies selectively engage one or the other of the contra rotating face gears in timing relationship with the axle shaft, with the clutch assembly being selectively operable through a bowden cable connection to a shiftable hand grip on the cleaner handle so that slight forward pressure on the hand grip by an operator is effective to engage the forward clutch and provide power assist drive to the cleaner in a forward direction while a slight rearward pressure on the handle grip by the operator provided a power assist in reverse drive. Further, means are provided to lock the transmission in a neutral configuration when the handle is in an upright position.

8 Claims, 5 Drawing Figures

POWER ASSIST DRIVE UPRIGHT VACUUM CLEANER AND POWER ASSIST DRIVE SYSTEM THEREFOR

DESCRIPTION

1. Field of the Invention

This invention relates to upright suction cleaners for floor coverings and the like, generally referred to as upright vacuum cleaners, and, more particularly, to a power assist drive upright vacuum cleaner and to drive systems therefor effective to assist the operator in propelling the cleaner forwardly or reversely with minimum effort.

2. Background of the Invention

An upright vacuum cleaner can weigh upwards of 15 pounds or so and requires that the user push or pull it by the application of force to the handle. While this force requirement might not appear to be burdensome, experience has shown that many women find the repetitive push and pull requirement needed to operate an upright vacuum cleaner to constitute a significant work load and this problem has been exacerbated in recent years with the popularity of high pile, deep shag carpets. Upright cleaners can become very tiring to manually propel in such carpets if the nozzle and brush height is set deep enough to clean well. Accordingly, it has been found desirable to provide upright vacuum cleaners with a power assist drive system to reduce the force required of the operator to maneuver such upright vacuum cleaners to a substantially lower level, in the range of about 1 pound force.

OBJECTS OF THE INVENTION

Bearing in mind the foregoing, it is a primary object of the present invention to provide an upright vacuum cleaner with a power assist drive system which reduces the force required of the operator to maneuver the vacuum cleaner to the range of approximately 1 pound force.

Another primary object of the present invention, in addition to the foregoing object, is the provision of such a power assist drive system which is driven from the vacuum cleaner blower motor and which is effective, under the operator's control, to assist in propelling the cleaner in either a forward or reverse direction.

Still another primary object of the present invention, in addition to each of the foregoing objects, is the provision of such power assist drive system which is smooth in operation, inexpensive to manufacture, and durable in use.

Yet still another primary object of the present invention, in addition to each of the foregoing objects, is the provision of such a power assist drive system which is responsive to small, low force movement of a control grip on the vacuum cleaner handle to augment a push or pull by an operator and to thereby enable the cleaner to be easily pushed, pulled, and be otherwise maneuvered by the operator.

Still another primary object of the present invention, in addition to each of the foregoing objects, is the provision of an upright suction carpet cleaner having a power assist drive system to enable the cleaner to be easily guided by an operator, even through deep shag carpets.

Yet still another primary object of the present invention, in addition to each of the foregoing objects, is the provision of novel and improved forward and reverse transmission drives for home appliances such as upright suction carpet cleaners.

Another and yet still further primary object of the present invention, in addition to each of the foregoing objects, is the provision of such power assist drives which are automatically locked into a neutral configuration when the cleaner handle is positioned in an upright orientation.

Another and yet still further primary object of the present invention, in addition to each of the foregoing objects, is the provision of an upright suction carpet cleaner incorporating a power assist drive which is smooth in operation and economical and durable to install and use.

It is a feature of the present invention that an upright suction carpet cleaner incorporating the power assist drive of the instant invention may be set to a sufficiently low nozzle height as to effectively deeply clean even a high pile or deep shag carpet while being yet easy to maneuver and manipulate.

The invention resides in the combination, construction, arrangement and disposition of the various component parts and elements incorporated in improved power assist drives for home appliances and in upright suction carpet cleaners incorporating the same in accordance with the principles of this invention. The present invention will be better understood and objects and important features other than those specifically enumerated above will become apparent when consideration is given to the following details and description which, when taken in conjunction with the annexed drawing, describes, discloses, illustrates and shows a preferred embodiment or modification of the present invention and what is presently considered and believed to be the best mode of practicing the principles thereof. Other embodiments or modifications may be suggested to those having the benefit of the teachings herein, and such other embodiments or modifications are intended to be reserved, especially as they fall within the scope and spirit of the subjoined claims.

SUMMARY OF THE INVENTION

In accordance with the present invention an upright suction carpet cleaner is provided with a solid rear axle shaft having wheels mounted on either end thereof and a power assist transmission generally medially mounted therewith. The transmission comprises a housing carrying an input pinion gear driven from the suction fan motor shaft in constant mesh with a pair of contra-rotating face gears freely rotatable upon the axle shaft. A pair of clutch assemblies selectively engage one or the other of the contra-rotating face gears in driving relationship with the axle shaft, with the clutch assemblies being selectively operable through a bowden cable connection to a shiftable hand grip on the cleaner handle so that slight forward pressure on the hand grip by an operator is effective to engage the forward clutch and provide power assist drive to the cleaner in a forward direction while a slight rearward pressure on the hand grip by the operator provides a power assist in reverse drive. Further, means are provided to lock transmission in a neutral configuration when the handle is in an upright position and to center the hand grip to release both clutches when no pressure is applied to the hand grip.

DESCRIPTION OF THE DRAWING

While the specification concludes with claims particularly pointing out and distinctly claiming the subject matter which is regarded as forming the present invention, it is believed the invention will be better understood from the following detailed description when taken in conjunction with the annexed drawing which discloses, illustrates and shows a preferred embodiment or modification of the present invention and what is presently considered and believed to be the best mode of practicing the principles thereof and wherein:

DETAILED DESCRIPTION OF THE INVENTION

Figure 1:
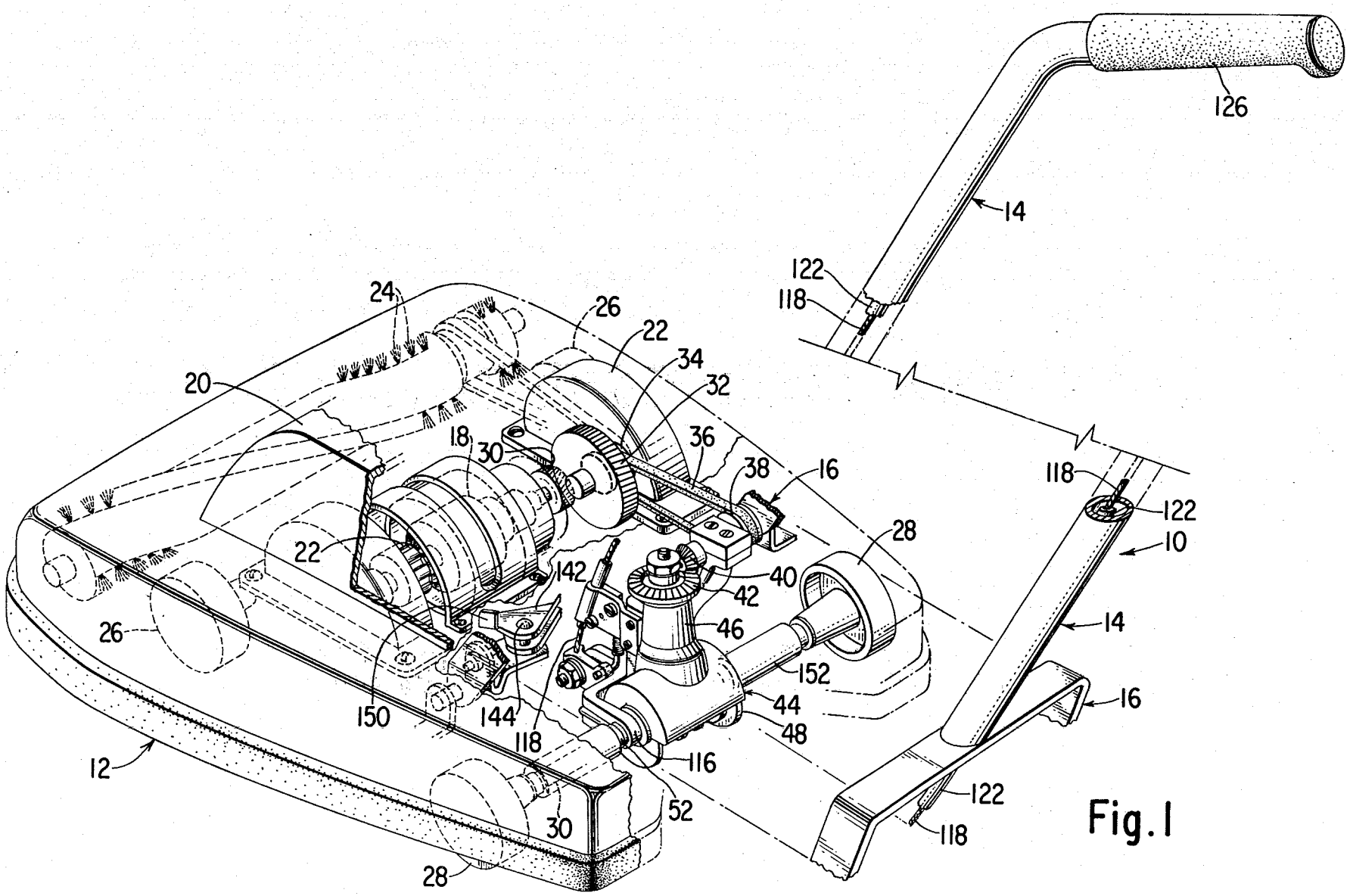
FIG. 1 is a perspective illustration, partially broken away of an upright suction carpet cleaner incorporating a power assist transmission and drive system in accordance with the present invention.

With reference now to the drawing there is shown and illustrated an upright suction carpet cleaner designated generally by the reference character 10 which includes a chassis 12 and a generally elongated handle 14 pivoted to the chassis 12, as on a handle bail 16. The chassis 12 carries a motor armature 18 beneath a housing cover 20 for driving a pair of suction fans 22 and a beater bar or agitator 24 for cleaning a carpet or other floor covering. The chassis rides on a pair of adjustable front wheels 26 and power driven rear wheels 28. The rear wheels 28 are mounted on a rear axle shaft 30 connected through a transmission 44 driven from the motor shaft of the motor 18, as through a gear train comprising a pinion gear 30 mounted on the motor shaft, a spur gear 32 driven therefrom, a driving timing belt pulley 34 coaxial with the spur gear 34, a timing belt 36 and a driven timing belt pulley 38. The driven timing belt pulley 38 has a beveled spur gear 40 in constant mesh with a driven beveled gear 42 carried by the transmission 44 operatively associated with the rear axle 30 as will be more fully described hereinafter.

The transmission 44 comprises the generally Y-shaped housing 46 having a pair of spaced apart bifurcations 48 each of which has a bearing aperture 50 into which a bearing 52 is engaged. Between the bifurcation 48, there is defined a chamber 53. Opposite the bifurcations 48, the housing 46 comprises a support arm 54 carrying a bearing 56 through which an intermediate shaft 58 rotatably extends. A shaft 58 carries the timing belt pulley 38 at one end thereof and the pinion gear 40 at the other end thereof. The housing 46 also carries a vertical shaft 60 which carries, at its upper end portion, the gear 42 and at its lower end portion, a pinion gear 62 within the chamber 53 in constant mesh with a pair of beveled face gears 64 and 66 rotatably carried on the axle shaft 30, as by means of sleeve bearings 68 and 70, respectively.

Since the pinion gear 62 is in constant mesh with the teeth of the gears 64 and 66, the gears 64 and 66 are in contra-rotation relative one another. In other words, one of the gears, and particularly gear 64 is rotated in a forward direction, that is, in a direction such that if coupled to the shaft 30 would drive the cleaner 10 in a forward direction while the other one of the gears 66 is rotated in a reverse direction, that is, in a direction such that if coupled to the shaft 30 would drive the cleaner rearwardly on a reverse direction. The transmission 44 further comprises a pair of clutch plates 72 and 74 coaxially mounted on the bearings 70 and 68, respectively, and mounted for rotation with the shaft 30, as by being connected thereto by drive pins 76 and 78 pressed into the shaft 30 and engaged with the respective ones of the clutch plates 72 and 74 in U-shaped generally axially extending slots 80 and 82, enabling the clutch plates 72 and 74 to axially slide along the shaft 30 while being rotatably coupled thereto. The outer faces of the gears 64 and 66 are provided with clutch facings 84 and 86, respectively for cooperation selectively with the clutch plates 72 and 74.

Figure 5:
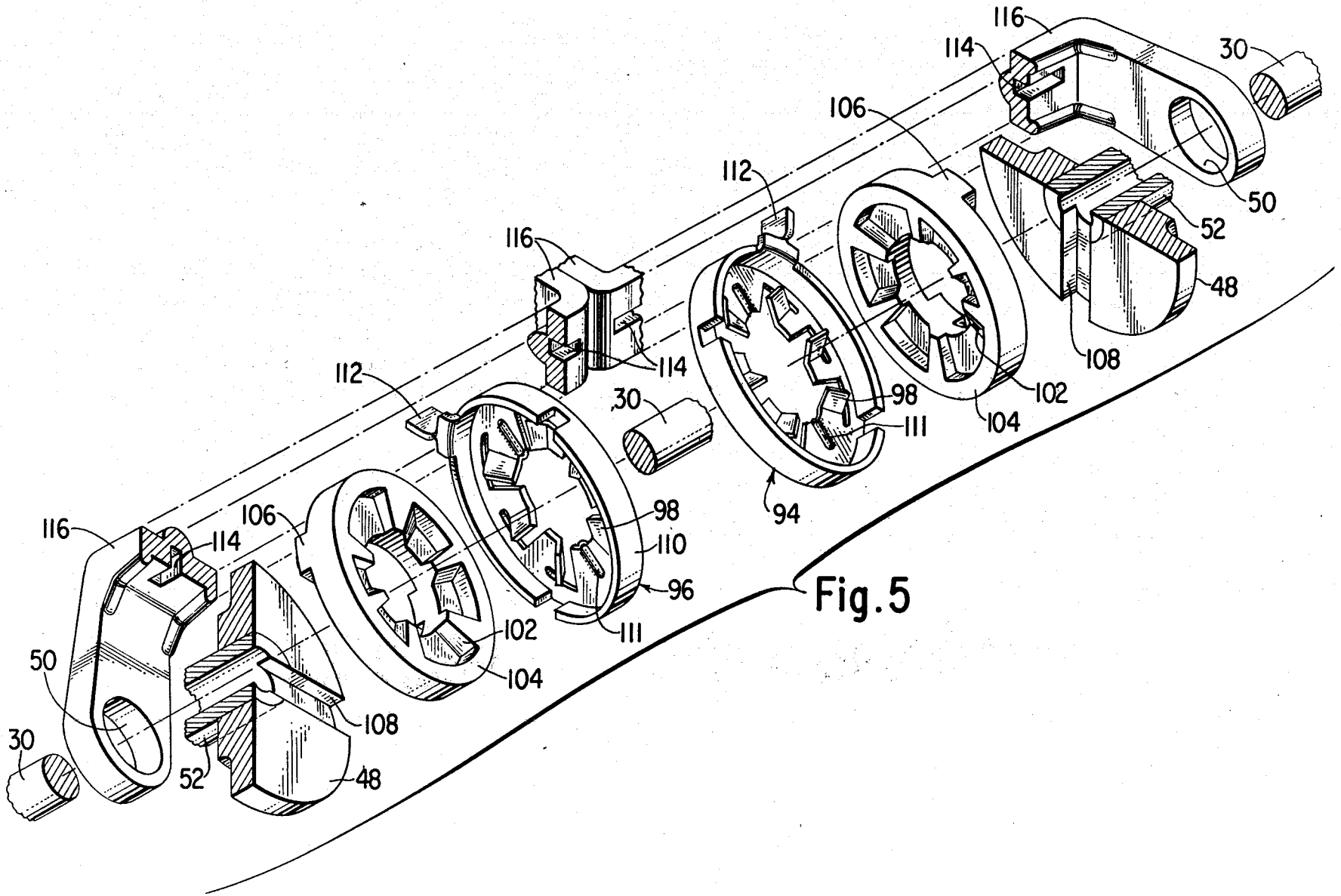
FIG. 5 is an exploded partial illustration of the transmission particularly illustrating the forward and reverse clutches thereof.

Mounted on the outer side of each of the clutch plates 72 and 74, that is, the sides thereof opposite the clutch facings 84 and 86, there are provided a pair of thrust bearings 90 and 92 which may, for example, comprise miniature needle bearing assemblies. Outside the respective bearings 90 and 92 are provided clutch operating levers, a "forward" operating lever 94 and a "reverse" operating level 96, respectively, most clearly shown in FIG. 5. Each of the operating levers 94 and 96 comprise a plurality of formed steel ramps 98. The operating levers 94 and 96 are, in fact, identical and acquire their "forward" and "reverse" operating natures due to the assembly relationship. The ramps 98 point or rise toward and cooperate with mating ramps 102 provided on operating members 104 positioned outwardly of the operating levers 94 and 96. The members 104 in turn, are keyed as by a key portion or lug 106 in a mating slot 108 in the transmission frame 48 so that the members 104 are restrained against rotation. The operating levers 94 and 96 further comprise a generally cylindrical rim 110 which surrounds the members 104 to guidingly support the operating levers 94 and 96 thereon while enabling some rotational movement of the operating levers 94 and 96 in a "floating" manner around the members 104. To aid in this floating action, the levers 94 and 96 also each comprise a pair of diametrically opposed raised radial ribs 111, raised oppositely the ramps 98 toward the bearings 90 so that the levers may rock slightly to be "self-aligning" on the bearings 90 when engaged. The levers 94 and 96 also further comprise an outwardly extending tang or tab 112 extending generally radially outwardly of the rim 110. The tabs or tangs 112 are, in turn, engaged within a slot 114 in an operating lever 116 in the form of a fork or yoke typically mounted on the exterior of the bearing 52 and positioned generally horizontally. As the operating lever 116 is lifted, the ramps of the reverse clutch lever 96 are effective to tighten the reverse clutch and thereby drive the axle shaft 30 and wheels 28 rearwardly while the forward clutch lever 94 merely floats. Conversely, if the operating lever 116 is moved downwardly, the ramps on the "forward" clutch lever 94 become effective, compressing the forward clutch and driving axle shaft 30 and wheels 28 in a forward direction. The core 118 of a bowden cable 120 is attached to the operating lever 116 and the casing 122 of the bowden cable 120 is connected with the transmission housing, as by means of a support clamp 124. The bowden cable 120 extends upwardly through the handle 14 to a hand grip control member 126 slidable on the upper end portion of the handle 14 so that when the hand grip 126 is pushed forwardly, it will move slightly on the handle 14, pushing the core 118 of the bowden cable downwardly and, as described above, engaging the transmission in a forward direction. Conversely, when the handle hand grip 126 is pulled rearwardly, the core 118 of the bowden cable 120 is pulled upwardly, raising the operating lever 116 and engaging the reverse drive. A suitable hand grip is disclosed in application Ser. No. 199,882 filed on Oct. 23, 1980 by Fredrick J. Ransom, assigned to the assignee of the instant application and incorporated herein by reference as fully and completely as if reproduced hereat.

The operating lever 116 is also connected with the bracket 124 by a centering mechanism which automatically returns the transmission 44 to neutral, that is, to a condition wherein both clutches are free floating so as to enable the wheels 28 to be free-wheeling when neither forward nor reverse pressure is applied to the hand grip 126. The centering mechanism comprises a centering rod 128 of generally L-shaped configuration having its lower leg pivotally connected with the operating lever 116 and having its upper leg extending through a notch 130 in a notched extension 132 mounted with the cable clamp 124 and the transmission housing 46. Also mounted on the rod 128 are a pair of coaxial spiral compression springs 134 and 136 disposed on opposite sides of the notched bracket extension 132 and bearing against it, both above and below. Further, the compression springs 134 and 136 are maintained slightly compressed by snap rings 138 and 140 mounted with the rod 128 at the distal ends of each of the springs 134 and 136. The springs 134 and 136, acting through the link rod 128 are therefore effective to center the operating lever 116 to urge the transmission 44 towards its neutral position whereas both clutches are free-wheeling. Acting through the bowden cable 120, the springs are also effective to center the hand grip 126 when no push or pull force is applied thereto by the operator.

Figures 2, 3, 4:
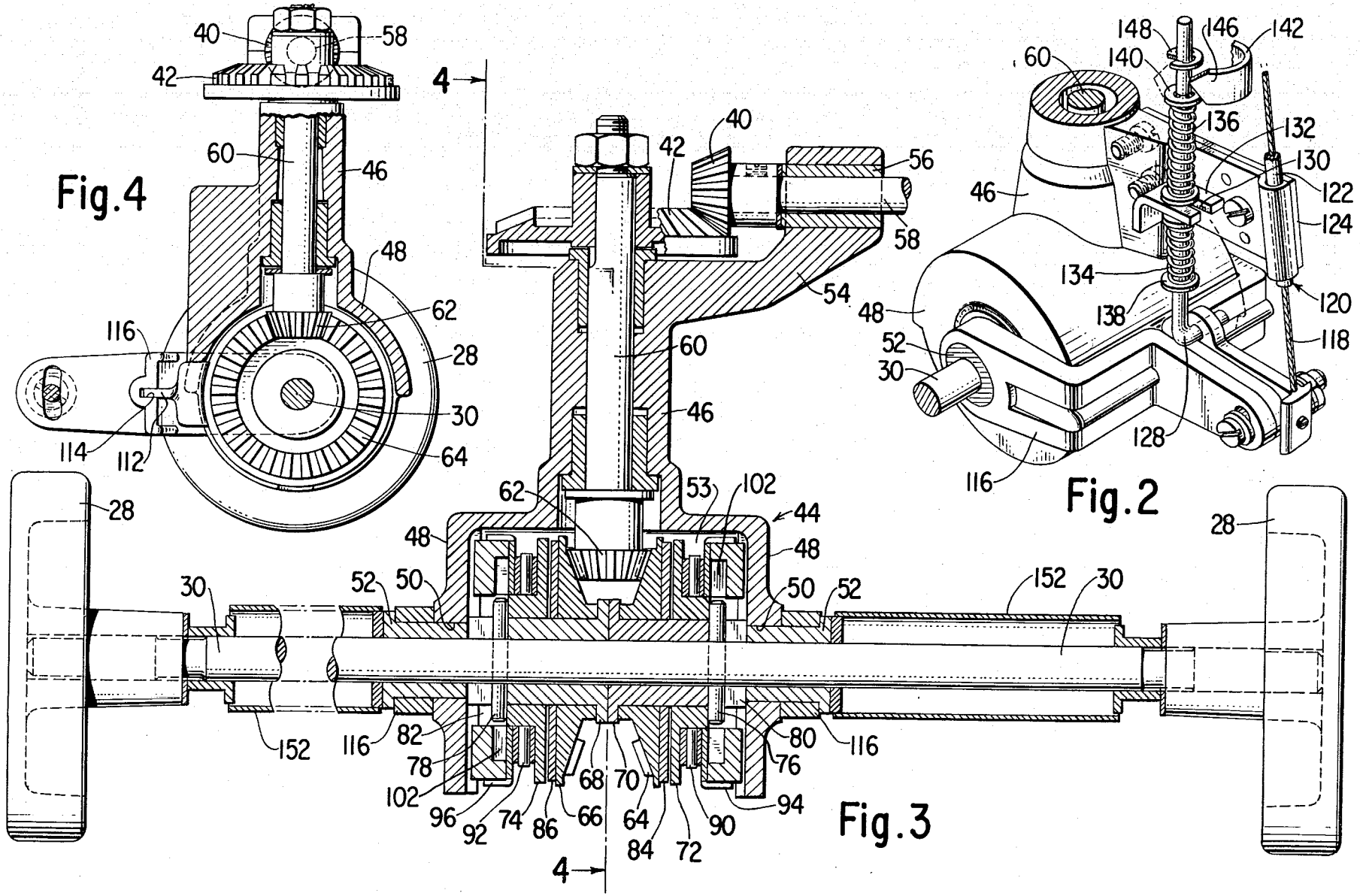
FIG. 2 is an enlarged perspective illustration of the power-assist transmission of the present invention.
FIG. 3 is an elevational cross sectional illustration of the power-assist transmission and rear axle assembly of the cleaner of FIG. 1.
FIG. 4 is a side elevational cross sectional illustration of the transmission taken along line 4—4 of FIG. 3.

Locking means are also provided for positively locking the transmission 44 in neutral when the handle 14 is rocked upwardly to its storage or upright position. A locking lever 142 is pivoted about a vertical axis on the chassis 12 of the cleaner adjacent the handle bail 16, as by being mounted on a pin 144. A free end portion 146 of the lever 142 is generally tapered or pointed as shown in FIG. 2 and a further snap ring 148 is provided on the link rod 128 spaced apart from the upper snap ring 140 a distance substantially equal to the maximum width of the tapered end 146 of the locking lever 142. The opposite end 150 of the latching lever 142 is provided with a paddle or tab portion for engagement by the handle bail 16 when the bail is in its upright position which is effective to pivot the locking lever 142 so as to engage the pointed end 146 thereof between the snap ring 140 and 148, as shown in phantom in FIG. 2, thereby positively moving the transmission operating lever 116 and the transmission 44 to their neutral positions and preventing any movement thereof away from the central or neutral position. Spring means, not shown, are provided for returning the latching lever 142 to the unlatched position thereof shown in solid lines in FIG. 2. The drive axle 30 may also be protected by means of dust cover tubes 152.

Hence, the transmission means of the present invention is effective to assist in movement of the cleaner 10 in response to push or pull motion of the operator on the hand grip 126 so as to enable the cleaner to be easily moved through even a deep shag or high pile carpet while the chassis is set to imbed the beater bar or brush 24 sufficiently deep enough into a carpet pile to clean it well. Further, the transmission is automatically locked into a neutral configuration when the handle is raised to a storage or upright position.

It is to be expressely understood that the invention is by no means limited to the forms of embodiment described and illustrated which have been by way of example only. In particular, it comprises all the means constituted technical equivalence to means described as well as their combination, should the latter be carried out according to the spirit of the invention.

I claim:

1. In an upright suction cleaner for floor coverings and the like having a chassis, an elongated handle pivotally mounted thereon, a drive motor and a pair of drive wheels mounted with said chassis for rotation with a common drive shaft, and a transmission for receiving rotary power from said drive motor and selectively applying rotary power to said common drive shaft, said transmission comprising a transmission housing through which said drive shaft extends generally horizontally and an input shaft extends generally perpendicular to said drive shaft, a spur gear mounted on said perpendicular input shaft in constant mesh with a pair of opposed face gears rotatably carried about said drive shaft for rotation in opposite rotational directions, a clutch operatively associated with each of said face gears on the outside surfaces thereof, a clutch operating lever free floating about said drive shaft outboard of each of said clutches, said operating levers each being provided with a plurality of ramp surfaces extending annularly about said drive shaft, means for cooperating with said ramp surfaces on said operating levers to initiate selective engagement of said clutches, an operating fork associated with both said operating levers so that movement of said fork in one direction will initiate cooperation between said ramp surfaces on one of said operating levers and said cooperating means to influence an axial shift of one of said clutches into engagement to drive said cleaner in a forward direction by one of said face gears and movement of said fork in the other direction will influence an axial shift of the other of said clutches to propel said cleaner in a reverse direction by the other of said face gears, and control means for connecting said fork to a hand grip on the cleaner handle whereby forward movement of said hand grip drives said cleaner forwardly and rearward movement of said hand grip drives said cleaner rearwardly.

2. The cleaner defined in claim 1 wherein said operating levers each comprise an outwardly extending tang and said operating fork is provided with an elongated groove extending generally parallel said drive shaft, said operating lever tangs being engaged within said groove.

3. The cleaner defined in claim 2 further comprising a centering rod carried by said operating fork and carrying a pair of opposed coil compression springs engaging a fixed support bracket therebetween tending to center said operating fork to enable both of said clutches to be free floating and free-wheeling.

4. The cleaner defined in claim 3 further comprising a pair of spaced apart snap rings carried on said operating rod and a latching lever pivotally carried on the cleaner chassis and engageable by the cleaner handle as it is moved to an upright or storage position for pivotal movement to be interposed between said snap rings whereby it latches said operating rod and said transmission in said neutral position.

5. Power assist drive system for an appliance such as an upright suction cleaner for floor coverings and the like having a chassis, an elongated handle pivotally mounted thereon, a drive motor and a pair of drive wheels mounted with said chassis for rotation with a common drive shaft, said drive system comprising a transmission for receiving rotary power from such drive motor and selectively applying rotary power to said common drive shaft, said transmission comprising a transmission housing through which said drive shaft extends generally horizontally and an input shaft extends generally perpendicular to said drive shaft, a spur gear mounted on said perpendicular input shaft in constant mesh with a pair of opposed face gears rotatably carried about said drive shaft for rotation in opposite rotational directions, a clutch operatively associated with each of said face gears on the outside surfaces thereof, a clutch operating lever free floating about said drive shaft outboard of each of said clutches, said operating levers each being provided with a plurality of ramp surfaces extending annularly about said drive shaft, means for cooperating with said ramp surfaces on said operating levers to initiate selective engagement of said clutches, an operating fork associated with both said operating levers so that movement of said fork in one direction will initiate cooperation between said ramp surfaces on one of said operating levers and said cooperating means to influence an axial shift of one of said clutches into engagement to drive said cleaner in a forward direction by one of said face gears and movement of said fork in the other direction will influence an axial shift of the other of said clutches to propel said cleaner in a reverse direction by the other of said face gears, and control means for connecting said fork to a hand grip on the cleaner handle whereby forward movement of said hand grip drives said cleaner forwardly and rearward movement of said hand grip drives said cleaner rearwardly.

6. Drive system defined in claim 5 wherein said operating levers each comprise an outwardly extending tang and said operating fork is provided with an elongated groove extending generally parallel said drive shaft, said operating lever tangs being engaged within said groove.

7. Drive system defined in claim 2 further comprising a centering rod carried by said operating fork and carrying a pair of opposed coil compression springs engaging a fixed support bracket therebetween tending to center said operating fork to enable both of said clutches to be free floating and free-wheeling.

8. Drive system defined in claim 3 further comprising a pair of spaced apart snap rings carried on said operating rod and a latching lever pivotally carried on the cleaner chassis and engageable by the appliance handle as it is moved to an upright or storage position for pivotal movement to be interposed between said snap rings whereby it latches said operating rod and said transmission in said neutral position.

* * * * *